US009159336B1

(12) United States Patent
Yang

(10) Patent No.: US 9,159,336 B1
(45) Date of Patent: Oct. 13, 2015

(54) CROSS-DOMAIN FILTERING FOR AUDIO NOISE REDUCTION

(71) Applicant: Rawles LLC, Wilmington, DE (US)

(72) Inventor: Jun Yang, San Jose, CA (US)

(73) Assignee: Rawles LLC, Wilmington, DE (US)

( * ) Notice: Subject to any disclaimer, the term of this patent is extended or adjusted under 35 U.S.C. 154(b) by 282 days.

(21) Appl. No.: 13/746,221

(22) Filed: Jan. 21, 2013

(51) Int. Cl.

| | |
|---|---|
| ***G10L 21/00*** | (2013.01) |
| ***G10L 21/02*** | (2013.01) |
| ***G10L 21/0208*** | (2013.01) |
| ***G10L 19/02*** | (2013.01) |

(52) U.S. Cl.
CPC ..... *G10L 21/0208* (2013.01); *G10L 19/02* (2013.01)

(58) Field of Classification Search
USPC ..... 704/226–228
See application file for complete search history.

(56) References Cited

U.S. PATENT DOCUMENTS

| | | | | |
|---|---|---|---|---|
| 5,706,395 | A * | 1/1998 | Arslan et al. | 704/226 |
| 6,175,602 | B1 * | 1/2001 | Gustafsson et al. | 375/346 |
| 2003/0004715 | A1 * | 1/2003 | Grover | 704/233 |
| 2005/0278172 | A1 * | 12/2005 | Koishida et al. | 704/227 |
| 2006/0129389 | A1 * | 6/2006 | Den Brinker et al. | 704/219 |
| 2011/0004470 | A1 * | 1/2011 | Konchitsky et al. | 704/226 |
| 2012/0223885 | A1 | 9/2012 | Perez | |

FOREIGN PATENT DOCUMENTS

WO WO2011088053 A2 7/2011

OTHER PUBLICATIONS

Basbug, et al, "Noise Reduction and Echo Cancellation Front-End for Speech Codecs", IEEE Transactions on Speech and Audio Processing, vol. 11, No. 1, Jan. 2003, pp. 1-13.

Gustafsson, et al., "Spectral Subtraction Using Reduced Delay Convolution and Adaptive Averaging", IEEE Transactions on Speech and Audio Processing, vol. 9, No. 8, Nov. 2001, pp. 799-807.

Hirsch, "Estimation of noise spectrum and its application to SNR-estimation and speech enhancement", ICSI Technical Report TR 93 012, Intl. Comp. Science Institute, Berkeley, CA, 1993, 32 pages.

Malah, et al., "Tracking speech-presence uncertainty to improve speech enhancement in non-stationary noise environments", ICASSP, 1999, pp. 789-792.

Martin, "Spectral Subtraction Based on Minimum Statistics", in Signal Processing VII, Theories and Applications. Proc. EUSIPCO 94, Edinburgh, Scotland, 1994, pp. 1182-1185.

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Jesse Pullias
(74) *Attorney, Agent, or Firm* — Lee & Hayes, PLLC

(57) ABSTRACT

An audio-based system may perform automatic noise reduction to enhance speech intelligibility in an audio signal. Described techniques include initially analyzing audio frames in the time domain to identify frames having relatively low power levels. Those frames are then further analyzed in the frequency domain to estimate noise. For example, the initially identified frames may be analyzed at each of multiple frequencies to detect the lowest exhibited power at each of those frequencies. The lowest power values are used as an estimation of noise across the frequency spectrum, and as the basis for calculating a spectral gain for filtering the audio signal in the frequency domain.

23 Claims, 4 Drawing Sheets

CROSS-DOMAIN FILTERING FOR AUDIO NOISE REDUCTION

BACKGROUND

Audio devices are often used in noisy environments in which received signals from microphones can be degraded by background noise and interference. In particular, background noise and interference can degrade the fidelity and intelligibility of speech.

There are many speech enhancement techniques that attempt to attenuate the noise, increase signal-to-noise ratios (SNR), and improve speech perception. However, speech enhancement processing under adverse conditions is still challenging. In particular, when the SNR is low or noise is non-stationary (i.e., time-varying), the results are plagued by speech distortions and unnatural sounding or fluctuating residual background noises. Thus, many noise reduction techniques make speech sound less pleasant, although they have improved SNR.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Described herein are techniques for reducing noise and enhancing speech intelligibility in an audio signal. In described embodiments, the techniques include initially analyzing audio frames in the time domain to identify frames having relatively low power levels. Those frames are then further analyzed in the frequency domain to estimate noise. More specifically, the initially identified frames are analyzed at each of multiple frequencies to detect the lowest exhibited power at each of those frequencies. The lowest power values are used as an estimation of noise across the frequency spectrum, and as the basis calculating a spectral gain for filtering the audio signal in the frequency domain.

For purposes of discussion, the discussion below assumes a single channel of audio input. However, the described techniques may also be used with multiple channels of input, including stereo inputs.

Figure 1:
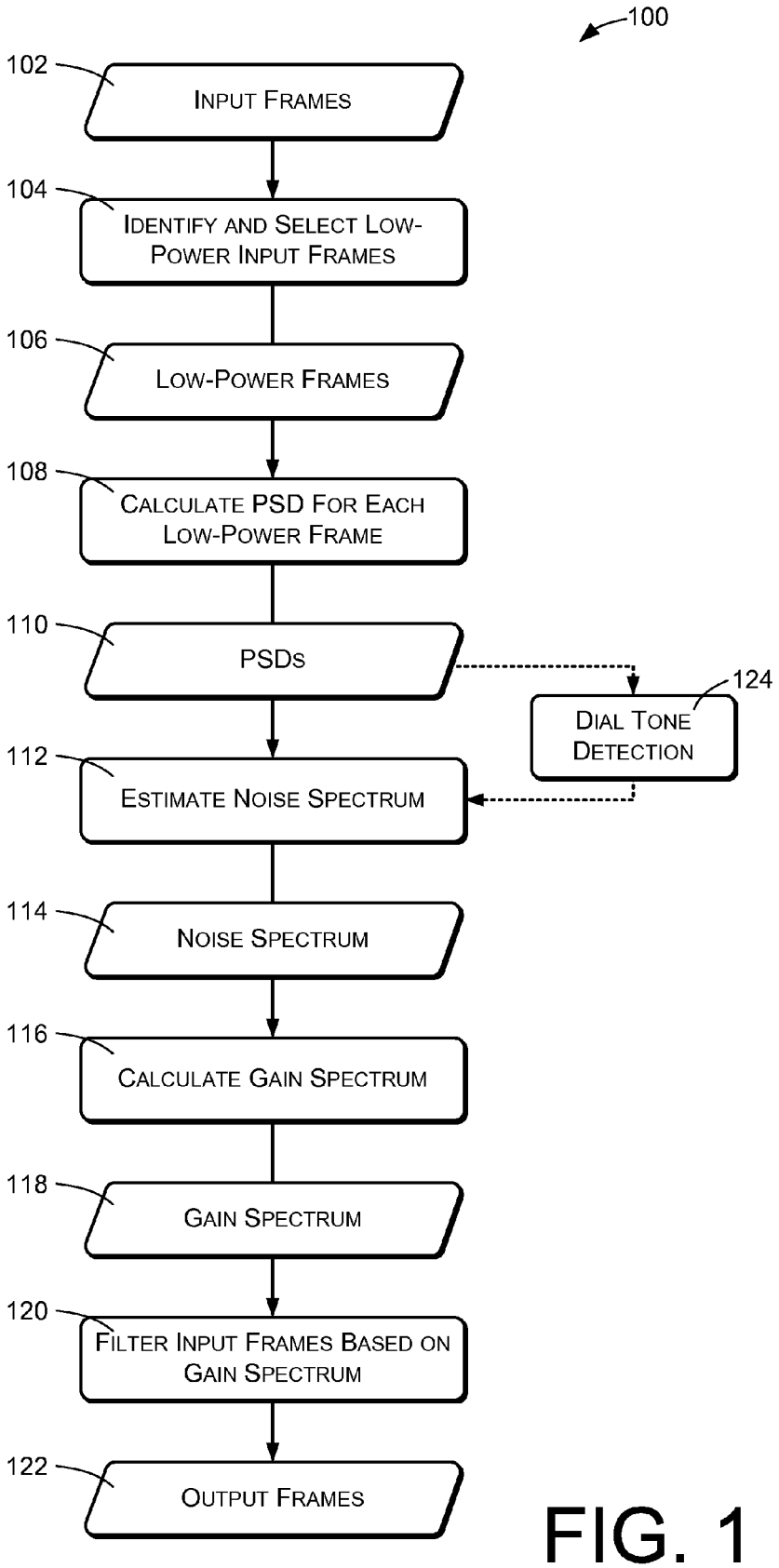
FIG. 1 is a flowchart illustrating an example method of noise reduction with respect to an audio signal.

FIG. 1 shows an example process 100 for automatic noise reduction with respect to an audio signal containing speech. The process 100 receives a plurality of input frames 102, each of which comprises a plurality of time-domain audio samples. Each sample represents an instantaneous amplitude of an audio signal.

An action 104 comprises identifying and selecting frames of the input frames 102 that have comparatively low audio levels. The audio level of a frame may be calculated in terms of power by summing the absolute sample values of the frame. Similarly, the power level for an input frame may in some embodiments comprise the average of the absolute values of the frame samples. In other embodiments, the power level for an input frame may comprise the sum or average of squared values of the frame samples.

The action 104 results in a plurality of low-level or low-power frames 106. In some embodiments, the power levels of the most recent M frames may be cached on an ongoing basis, and the action 104 may comprise selecting the lowest-power frames from among the most recent M frames. Thus, the low-power frames 106 may comprise low-power frames from a moving window of the input frames 102, representing the M most recent frames.

An action 108 comprises calculating a power spectral density (PSD) for each of the selected low-power frames 106. The PSD for a particular frame indicates power values of the frame over a range of frequency values. In the described embodiment, a PSD may be calculated by performing an N-point fast Fourier transform (N-FFT) on a corresponding one of the low-power frames 106, to convert the frame to the frequency domain.

When the PSD is based on an FFT, the power values of the PSD may correspond to individual frequencies, which are referred to as frequency bins in the context of FFT. However, in certain embodiments the PSD may be converted from frequency bins to frequency bands so that each frequency band corresponds to a range of frequencies or FFT frequency bins. This will be described in more detail below, with reference to FIG. 2.

The action 108 results in a plurality of PSDs 110, corresponding respectively to individual ones of the low-power frames 106.

An action 112 comprises estimating a noise spectrum 114, based at least in part on the PSDs 110. The noise spectrum 114 indicates estimated noise for each of multiple frequency values. The action 112 may be performed by analyzing a plurality of the most recent PSDs 110, which correspond to the most recently identified low-power frames 106, to find the lowest represented power value at each of the frequency values. For example, all of the power values corresponding to a particular frequency value (from all of the PSDs 110), are compared to find the lowest of those power values. This is repeated for each of the frequency values, to find a statistically-based spectrum of noise values across the frequency values. These noise values form the noise spectrum 114.

An action 116 comprises calculating a gain spectrum 118, based at least in part on the noise spectrum 114. The gain spectrum may be calculated by (a) calculating a first ratio of the PSD corresponding to the current input frame to the noise spectrum 114, (b) smoothing the first ratio over time, (c) calculating a second ratio of the smoothed first ratio to the sum of the first smoothed ratio and 1.0, and (d) limiting the range of the second ratio. This results in a gain value for each bin or band.

An action 120 comprises applying the gain spectrum 118 to the input frames to produce corresponding output frames 122. This may comprise filtering the input frames 102 based on the gain spectrum 118 in the frequency domain.

In some embodiments, dial tone detection may be performed in an action 124, and the noise spectrum estimation may account for the presence of a dial tone. More specifically, frequencies corresponding to dial tones may be disregarded when estimating the noise spectrum in the action 112.

The dial tone detection 124 may be based on the PSDs of the current input frame. Identifying a potential dial frequency may be performed by searching the maximum values of the PSDs over all the frequency bins. By verifying the variation and the range of the potential tone frequency, it is possible to determine whether or not the current frame represents a dial tone.

Figure 2:
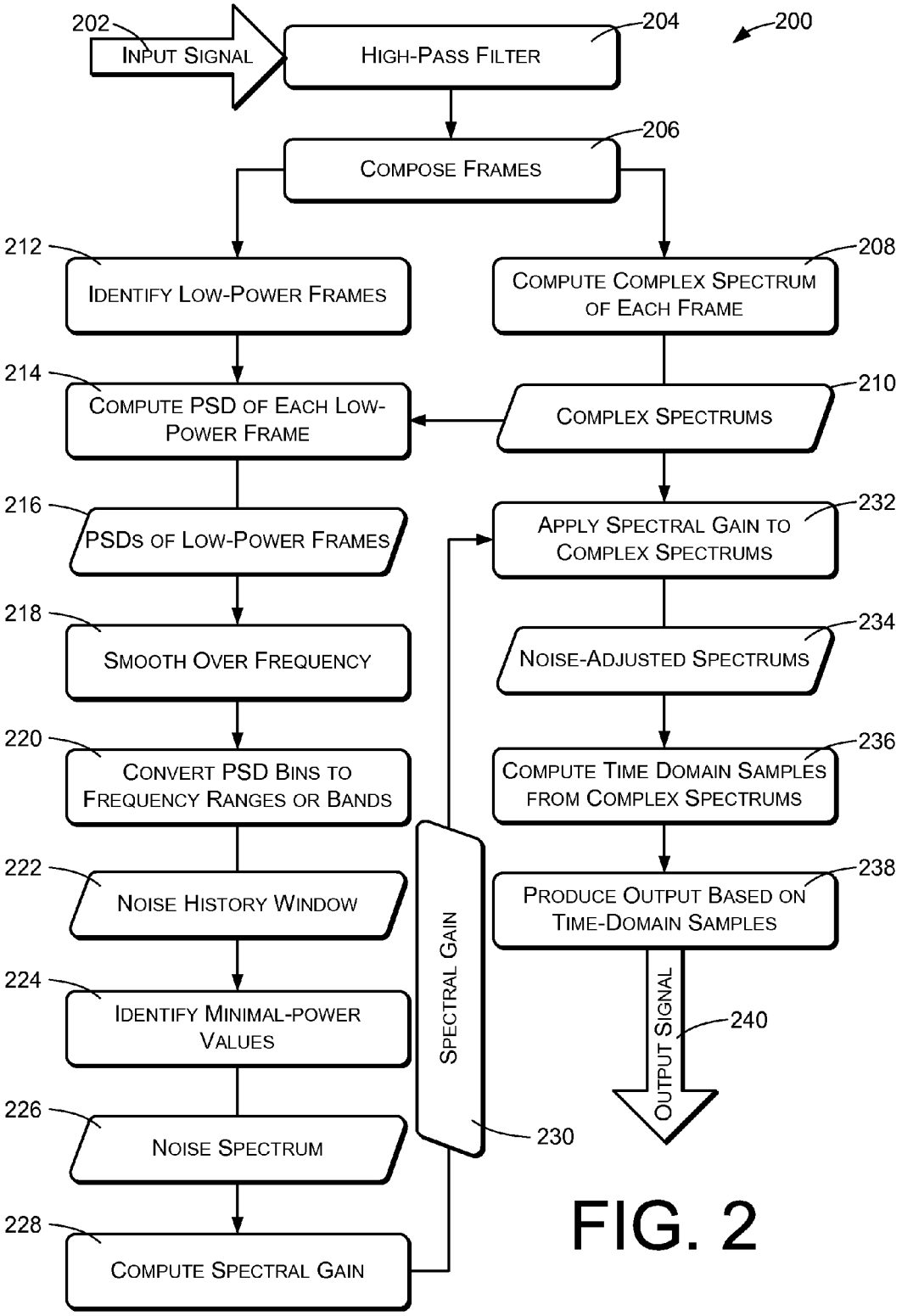
FIG. 2 is a flowchart illustrating further details regarding audio noise reduction.

FIG. 2 shows a more detailed example 200 for performing noise reduction with respect to a received audio signal 202. The audio signal 202 may comprise a continuous sequence of digitally sampled amplitude values. For example, audio may be evaluated in the time domain at a predetermined sampling rate to produce sampled amplitude values.

An action 204 comprises high-pass filtering of the input audio signal 202 to filter out DC components of the audio signal as well to filter out as some low frequency noise. For wideband speech applications, a cut-off frequency of 60 Hertz may be used in the high-pass filtering 204. For use in other environments, such as Digital Enhanced Cordless Telecommunications (DECT) systems, a cut-off frequency of 100 Hertz may be more suitable. As an example, the filtering 204 may comprise a second-order high-pass filter.

In some situations, adequate high-pass filtering may have already been performed by earlier portions of an audio processing path, such as by echo cancellation or beam-former components. In such situations, it may not be necessary to duplicate the filtering here.

An action 206 comprises receiving filtered input samples and arranging them in frames. For convenience in later portions of the process 200, each frame may comprise a number of sampled values that is equal to a power of two, such as 128 samples or 256 samples. In some cases, frames may be composed so that they contain overlapping sequences of audio samples. That is, a portion of one frame and a portion of an immediately subsequent frame may have samples corresponding to the same period of time. In certain situations, a portion of a frame may be padded with zero values to produce a number of values equal to the desired frame size.

An action 208 comprises computing or calculating a complex frequency spectrum for each frame, resulting in a plurality of complex frequency spectrums 210 corresponding respectively to each of the received audio frames. The action 208 may be implemented with Hanning windowing and a fast Fourier transform (FFT). Each complex spectrum 210 indicates real and imaginary components of the corresponding audio frame in the frequency domain. Each complex spectrum 210 has values corresponding respectively to multiple discrete frequencies, which are referred to as frequency bins in the context of FFT.

An action 212 is also performed for each of the received frames. The action 212 comprises identifying low-power frames from among the received audio frames. This may be performed by squaring and summing the values of individual frames to produce a power level for each frame, and then identifying multiple frames whose audio or power levels are lower than those of the other frames. In some implementations, a buffer may be maintained to indicate the power levels of the most recently received frames, such as the last M received frames, where M may be equal to six. As each new frame is received, the buffer is checked to identify which of the last M frames exhibits the lowest power level, and the identified frame is produced as the output of the action 212.

The remaining actions along the left side of FIG. 2 are performed with respect to the low-power frames identified in the action 212.

An action 214 comprises calculating the power spectral density (PSD) of each of the low-power frames identified by the action 212. The PSD of an individual frame comprises a power value for each of multiple frequency values or frequency bins, based on the complex spectrum 210. Power for an individual frequency may be calculated as $I^2+R^2$, where I is the imaginary (phase-related) part at the corresponding frequency of the complex spectrum 210 and R is the real (amplitude) related part at the corresponding frequency of the complex spectrum 210. The frequencies at which the power values are calculated correspond to the frequency bins of the complex spectrum 210 as produced by the FFT.

An action 218 is performed with respect to each of the calculated PSDs. The action 218 comprises smoothing the power values of each PSD 216 across the frequency values of the PSD. In certain embodiments, this may be performed by a linear phase finite impulse response (FIR) filter having a filter order of 5.

An action 220 comprises converting each PSD 216 so that its values correspond to ranges or bands of frequencies rather than to individual frequencies or frequency bins. The power value for a particular range of frequencies may be calculated as the average of the power values of the frequencies or bins encompassed by the range. As an example, the PSDs may originally have values corresponding to 64 discrete frequencies or bins, and the conversion 220 may convert the PSDs so that they each have 30 values, corresponding respectively to different bands or ranges of frequencies. In some embodiments, higher frequency ranges may encompass larger numbers of FFT frequency bins than lower frequency ranges.

The actions 214, 218, and 220 result in a noise history window 222, which may be configured to include the range-based PSDs of the most recently processed low-power frames. Each of the range-based PSDs indicates power values for multiple ranges of frequencies, and each of the PSDs of the noise history 222 corresponds to a recently received or processed low-power frame.

The size of the noise history window 222 may be configured depending on various factors. In the described example, the size of the noise history window 222 is equal to six frames. The selected size of the noise history window determines the speed at which the process 200 will respond to dynamic changes in noise.

An action 224 comprises, for each frequency range represented within the PSDs of the noise history window 222, finding the lowest represented power value from among the PSDs of the noise history window 222. These values are then compiled to create a noise spectrum 226, which represents a low or minimum power value at each of the chosen frequency bands. A minimum power value at a particular frequency band within the noise spectrum 226 is equal to the lowest power value observed at that frequency band from among the PSDs of the noise history window 222. Power values produced by detected dial tones may be ignored by the action 224.

An action 228 comprises computing a spectral gain 230 based on the noise spectrum 226. Computation of the spectral gain 230 is based on the noise spectrum 226, and is described in more detail below with reference to FIG. 3.

An action 232 comprises applying the most recently calculated spectral gain to the complex spectrums 210 to produce noise-adjusted complex spectrums 234 corresponding respectively to the received input frames. This is performed in the frequency domain by multiplying the gain of each frequency value, indicated by the spectral gain 230, with the frequency-corresponding value of the complex spectrum 210.

An action 236 comprises computing or reconstructing time domain samples from the noise-adjusted complex spectrums 234. This may be performed by a combination of inverse FFT (IFFT) and overlap-and-add methodologies.

An action 238 comprises producing an output signal 240 based on the computed time domain samples.

Figure 3:
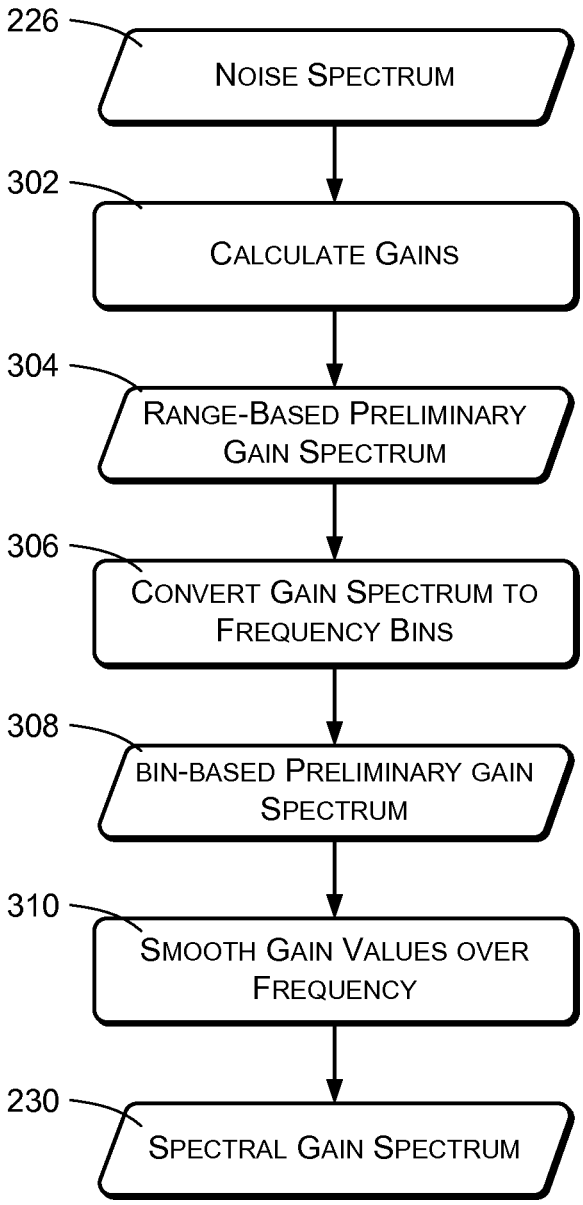
FIG. 3 is a flowchart illustrating an example of calculating spectral gain in the context set forth with reference to FIG. 2.

FIG. 3 illustrates an example process 300 that may be used to implement the action 228 of FIG. 2, which comprises calculating the spectral gain 230.

An action 302 comprises calculating a gain corresponding to each of the frequency ranges of the noise spectrum 226. For each frequency band, this may comprise (a) calculating a first ratio of the PSD corresponding to the current input frame to the noise spectrum, (b) smoothing the first ratio over time, (c) calculating a second ratio of the smoothed ratio to the sum of the smoothed ratio and 1.0, and (d) limiting the second ratio to a predefined range. The resulting gains are referred to in FIG. 3 as a range-based preliminary gain spectrum 304.

An action 306 comprises converting the range-based values of the range-based preliminary intermediate gain spectrum 304 to frequency-based or bin-based values, to correspond with the frequency bins of the complex spectrums 210. The resulting gains are referred to in FIG. 3 as a bin-based preliminary gain spectrum 308.

An action 310 comprises smoothing the values of the bin-based preliminary gain spectrum 308 across frequency. This produces what is referred to in FIG. 2 as the spectral gain 230. In certain embodiments, this smoothing may be performed by a linear phase finite impulse response (FIR) filter having a filter order of 5.

Figure 4:
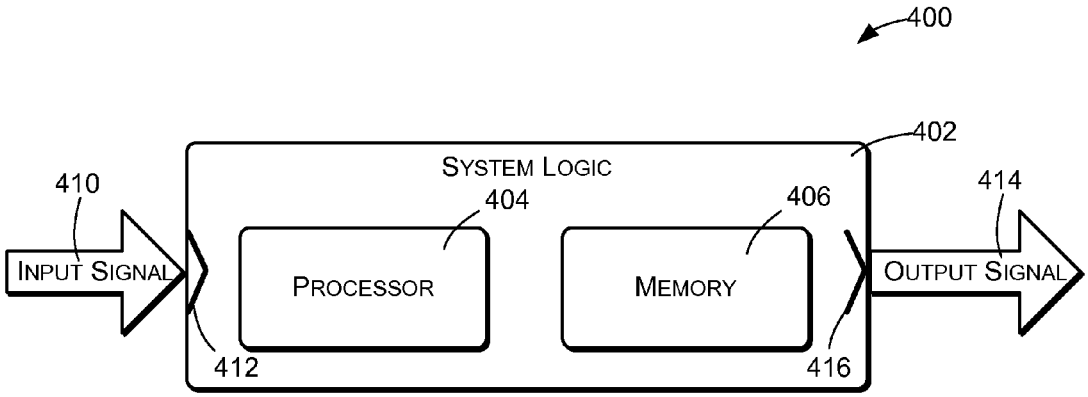
FIG. 4 is a block diagram of a system that may be used to apply audio noise reduction in accordance with the techniques described with reference to FIGS. 1-3.

FIG. 4 shows an example of an audio system, element, or component 400 that may be used to perform automatic noise reduction with respect to an audio signal. The audio system 400 comprises system logic 402, which in some embodiments may comprise a programmable device or system formed by a processor 404, associated memory 406, and other related components. The processor 404 may be a digital processor, a signal processor, or similar type of device that performs operations based on instructions and/or programs stored in the memory 406. In other embodiments, the functionality attributed herein to the system logic 402 may be performed by other means, including non-programmable elements such as analog components, discrete logic elements, and so forth.

The system logic 402 is configured to implement the functionality described above. Generally, the system 400 receives an input signal 408 at an input port 410 and processes the input signal 408 to produce an output signal 412 at an output port 414. The input signal 408 may comprise a single mono audio channel, a pair of stereo audio channels, or a set of more than two audio channels. Similarly, the output signal 412 may comprise a single mono audio channel, a pair of stereo audio channels, or a set of more than two audio channels. The input and output signals may comprise analog or digital signals, and may represent audio in any of various different formats.

The techniques described above are assumed in the given examples to be implemented in the general context of computer-executable instructions or software, such as program modules, that are stored in the memory 406 and executed by the processor 404. Generally, program modules include routines, programs, objects, components, data structures, etc., and define operating logic for performing particular tasks or implement particular abstract data types. The memory 406 may comprise computer storage media and may include volatile and nonvolatile memory. The memory 406 may include, but is not limited to, RAM, ROM, EEPROM, flash memory, or other memory technology, or any other medium which can be used to store media items or applications and data which can be accessed by the system logic 402. Software may be stored and distributed in various ways and using different means, and the particular software storage and execution configurations described above may be varied in many different ways. Thus, software implementing the techniques described above may be distributed on various types of computer-readable media, not limited to the forms of memory that are specifically described.

The techniques described above allow for noise compensation and reduction without requiring automatic gain control, and without the distortions that are often introduced by automatic gain control. In addition, the techniques described above have relatively low computational intensity, which is improved by rage-based processing and the avoidance of special math functions such as square root, logarithmic, and trigonometric functions.

Although the discussion above sets forth an example implementation of the described techniques, other architectures may be used to implement the described functionality, and are intended to be within the scope of this disclosure. Furthermore, although specific distributions of responsibilities are defined above for purposes of discussion, the various functions and responsibilities might be distributed and divided in different ways, depending on circumstances.

Furthermore, although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A computing device, comprising:

a processor;

an audio input;

an audio output;

memory, accessible by the processor and storing instructions that are executable by the processor to perform acts comprising:

receiving multiple frames of time-domain audio samples at the audio input;

identifying frames of the multiple frames having audio levels that are lower than other frames of the multiple frames;

calculating frequency-domain spectrums of individual frames of the identified frames;

calculating a power spectral density for individual frames of the identified frames based at least in part on the frequency-domain spectrums of the individual frames, wherein individual ones of the power spectral densities indicate power values of a corresponding one of the identified frames at multiple frequency values;

smoothing individual ones of the power spectral densities across the multiple frequency values;

at individual ones of the multiple frequency values, identifying a minimum of the power values of the smoothed power spectral densities;

calculating a spectral gain based at least in part on the identified minimum power values, wherein the spectral gain indicates a gain value for individual ones of the multiple frequency values;

smoothing the spectral gain across the multiple frequency values;

filtering the frequency-domain spectrums of the multiple frames based at least in part on the spectral gain; and producing output audio samples at the audio output based at least in part on the filtered frequency-domain spectrums of the multiple frames.

2. The computing device of claim 1, wherein an individual frequency value corresponds to a range of frequencies.

3. The computing device of claim 1, wherein calculating the frequency-domain spectrums is performed using a fast Fourier transform (FFT).

4. The computing device of claim 1, wherein calculating the frequency-domain spectrums is performed using a fast Fourier transform (FFT), and wherein the frequency values correspond to frequency bins of the fast Fourier transform.

5. The computing device of claim 1, wherein calculating the frequency-domain spectrums is performed using a fast Fourier transform (FFT), and wherein individual frequency values of the frequency values correspond to a range of frequency bins of the fast Fourier transform.

6. The computing device of claim 1, wherein producing the output audio samples is performed using an inverse fast Fourier transform (FFT).

7. The computing device of claim 1, wherein producing the output samples comprises converting the filtered frequency-domain spectrums of the multiple frames to the time domain.

8. The computing device of claim 1, further comprising detecting a dial tone based at least in part on the power spectral densities, wherein identifying the minimum power values and calculating the spectral gain are responsive at least in part to the detection of the dial tone.

9. The computing device of claim 1, wherein smoothing individual ones of the power spectral densities comprises filtering the individual ones of the power spectral densities with a linear phase finite impulse response filter.

10. A method, comprising:

analyzing multiple time-domain audio frames;

identifying, based at least in part on the analyzing, audio frames of the multiple time-domain audio frames that have lower audio levels than others of the multiple time-domain audio frames;

calculating, based at least in part on the identifying of the identified audio frames, a power spectral density for individual ones of the identified audio frames, wherein an individual power spectral density indicates power values of a corresponding one of the identified audio frames at multiple frequency values;

for individual ones of the multiple frequency values, identifying a low power value from the power spectral densities of the identified audio frames; and calculating a spectral gain based at least in part on the identified low power values.

11. The method of claim 10, further comprising smoothing the power values of individual ones of the power spectral densities over the multiple frequencies.

12. The method of claim 10, wherein the spectral gain indicates gain values for individual ones of the multiple frequencies, the method further comprising smoothing the gain values of the spectral gain over the multiple frequencies.

13. The method of claim 10, further comprising:

calculating a complex spectrum for individual ones of the time-domain audio frames;

filtering the complex spectrums with the calculated spectral gain; and producing a time-domain audio output based at least in part on the filtered complex spectrums.

14. The method of claim 10, wherein individual frequency values correspond to a plurality of fast Fourier Transform (FFT) frequency bins.

15. The method of claim 10, further comprising:

calculating a complex spectrum for individual ones of the time-domain audio frames; and wherein calculating the power spectral densities is based at least on part on the calculated complex spectrums.

16. The method of claim 10, further comprising detecting a dial tone based at least in part on the power spectral densities, wherein calculating the spectral gain is responsive at least in part to detecting the dial tone.

17. One or more non-transitory computer-readable media storing computer-executable instructions that, when executed by one or more processors, cause the one or more processors to perform acts comprising:

analyzing multiple time-domain audio frames;

identifying, based at least in part on the analyzing, audio frames of the multiple time-domain audio frames that have lower audio levels than others of the multiple time-domain audio frames;

calculating, based at least in part on the identifying of the identified audio frames, a power spectral density for individual ones of the identified audio frames, wherein an individual power spectral density indicates power values of a corresponding one of the identified audio frames at multiple frequency values; and estimating a noise spectrum based at least on part on the power spectral densities of the identified audio frames, wherein the noise spectrum comprises, for a particular frequency value of the multiple frequencies values, a low power value of the spectral densities of the identified audio frames at the particular frequency value.

18. The one or more non-transitory computer-readable media of claim 17, the acts further comprising smoothing the power values of an individual power spectral density across the multiple frequencies values.

19. The one or more non-transitory computer-readable media of claim 17, the acts further comprising:

calculating a spectral gain based at least in part on the estimated noise spectrum, wherein the spectral gain indicates gain values for individual ones of the multiple frequency values; and smoothing the gain values of the spectral gain across the multiple frequency values.

20. The one or more non-transitory computer-readable media of claim 17, the acts further comprising:

calculating a frequency-domain spectrum for individual ones of the time-domain audio frames; and filtering the frequency-domain spectrums based at least in part on the estimated noise spectrum.

21. The one or more non-transitory computer-readable media of claim 17, wherein an individual frequency value corresponds to a plurality of fast Fourier transform (FFT) frequency bins.

22. The one or more non-transitory computer-readable media of claim 17, the acts further comprising:

calculating a frequency-domain spectrum for individual ones of the time-domain audio frames; and wherein calculating the power spectral densities is based at least on part on the calculated frequency-domain spectrums.

23. The one or more non-transitory computer-readable media of claim 17, the acts further comprising detecting a dial tone based at least in part on the power spectral densities, wherein estimating the noise spectrum is based at least in part on detecting the dial tone.

* * * * *